US009526297B2

(12) United States Patent
Davis

(10) Patent No.: US 9,526,297 B2
(45) Date of Patent: Dec. 27, 2016

(54) FOOTWEAR SOLE WITH HONEYCOMB REINFORCEMENT SHANK

(75) Inventor: Russell Davis, Danville, CA (US)

(73) Assignee: Ariat International, Inc., Union City, CA (US)

( * ) Notice: Subject to any disclaimer, the term of this patent is extended or adjusted under 35 U.S.C. 154(b) by 603 days.

(21) Appl. No.: 12/324,536

(22) Filed: Nov. 26, 2008

(65) Prior Publication Data

US 2010/0126044 A1 May 27, 2010

(51) Int. Cl.

| | |
|---|---|
| ***A43B 1/00*** | (2006.01) |
| ***A43B 13/12*** | (2006.01) |
| ***A43B 13/40*** | (2006.01) |
| ***A43B 13/42*** | (2006.01) |
| ***A43B 17/00*** | (2006.01) |
| ***A43B 13/04*** | (2006.01) |
| ***A43B 7/14*** | (2006.01) |
| ***A43B 13/14*** | (2006.01) |

(52) U.S. Cl.

CPC ..... *A43B 13/04* (2013.01); *A43B 1/0009* (2013.01); *A43B 7/144* (2013.01); *A43B 7/1445* (2013.01); *A43B 13/12* (2013.01); *A43B 13/141* (2013.01); *A43B 13/40* (2013.01); *A43B 13/42* (2013.01); *A43B 17/006* (2013.01)

(58) Field of Classification Search

CPC ..... A43B 1/0009; A43B 5/006; A43B 17/00; A43B 17/003; A43B 17/006; A43B 17/14; A43B 23/22

USPC ..... 36/72 A, 76 R, 76 C, 107, 108, 182

See application file for complete search history.

(56) References Cited

U.S. PATENT DOCUMENTS

| | | | | |
|---|---|---|---|---|
| 4,506,460 | A * | 3/1985 | Rudy | 36/28 |
| 4,617,745 | A * | 10/1986 | Batra | 36/3 B |
| 4,835,884 | A * | 6/1989 | Bianchini | A43B 13/28 36/108 |
| 5,720,117 | A * | 2/1998 | Toschi | A43B 23/22 36/169 |
| 5,829,172 | A * | 11/1998 | Kaneko | 36/108 |
| 5,832,634 | A * | 11/1998 | Wong | 36/107 |
| 6,681,501 | B1 | 1/2004 | Polifroni | |

(Continued)

FOREIGN PATENT DOCUMENTS

| | | |
|---|---|---|
| CN | 1232653 | 10/1999 |
| CN | 2563972 Y | 8/2003 |

(Continued)

OTHER PUBLICATIONS

English-language abstract of German Patent No. DE 20200501969101, as provided by WIPO Feb. 16, 2010.

(Continued)

*Primary Examiner* — Khoa Huynh
*Assistant Examiner* — Sharon M Prange
(74) *Attorney, Agent, or Firm* — Dascenzo Intellectual Property Law, P.C.; David S. D'Ascenzo

(57) ABSTRACT

A footwear sole includes a shank with a honeycomb reinforcement structure, heel aperture and rib receptacle in the bottom side of a front region of the shank. A fabric sheath surrounds the shank. Polymers are formed in the rib receptacle, in the heel aperture and on the top side of the shank. A foot bed insert is used with the shank. The foot bed insert includes a fabric upper layer, a foam forefoot component, a foam matrix connected to the foam forefoot component, a heel cradle and a heel strike region.

23 Claims, 6 Drawing Sheets

(56) References Cited

U.S. PATENT DOCUMENTS

| | | | | |
|---|---|---|---|---|
| 6,938,362 | B2 * | 9/2005 | Saillet et al. | 36/117.3 |
| 7,107,705 | B2 | 9/2006 | Dalton et al. | |
| D543,680 | S | 6/2007 | Dean et al. | |
| 7,380,353 | B2 * | 6/2008 | Feller et al. | 36/76 R |
| 7,614,164 | B2 * | 11/2009 | Morales et al. | 36/76 C |
| 7,681,333 | B2 * | 3/2010 | Dardinski et al. | 36/100 |
| 7,854,075 | B2 * | 12/2010 | Kosmas | 36/44 |
| 8,201,346 | B2 * | 6/2012 | Darby et al. | 36/76 R |
| 2001/0007177 | A1 * | 7/2001 | Brown et al. | 36/27 |
| 2005/0223604 | A1 * | 10/2005 | Neuner | 36/174 |
| 2006/0107552 | A1 | 5/2006 | Clark et al. | |
| 2007/0017122 | A1 * | 1/2007 | Feller et al. | 36/35 R |

FOREIGN PATENT DOCUMENTS

| | | |
|---|---|---|
| CN | 1947610 | 4/2007 |
| CN | 201070045 | 6/2008 |
| DE | 202005019691 U1 | 5/2007 |

OTHER PUBLICATIONS

English-language abstract of Chinese Patent No. CN 1232653, European Patent Office, Oct. 27, 1999.
English-language abstract of Chinese Patent No. CN 1947610, European Patent Office, Apr. 18, 2007.
English-language abstract of Chinese Patent No. CN 201070045, European Patent Office, Jun. 11, 2008.

* cited by examiner

FOOTWEAR SOLE WITH HONEYCOMB REINFORCEMENT SHANK

FIELD OF THE INVENTION

This invention relates generally to footwear. More particularly, this invention relates to a footwear sole with integrated components that foster manufacturing, low mass, heat transfer and flexibility benefits.

BACKGROUND OF THE INVENTION

Efforts to improve properties of footwear soles are ongoing. In general, it is desirable to have structurally strong insole components that are also light in weight. The structurally strong components must be combined with flexible components to cumulatively provide foot stability and shock absorption. At the same time, heat transfer issues need to be considered, particularly with high performance footwear. Cost is an issue for any manufactured product. Accordingly, the manufacturing of a footwear sole should be optimized to reduce costs.

SUMMARY OF THE INVENTION

A footwear sole includes a shank with a honeycomb reinforcement structure, heel aperture and rib receptacle in the bottom side of a front region of the shank. A fabric sheath surrounds the shank. Polymers are formed in the rib receptacle, in the heel aperture and on the top side of the shank. A foot bed insert is used with the shank. The foot bed insert includes a fabric upper layer, a foam forefoot component, a foam matrix connected to the foam forefoot component, a heel cradle and a heel strike region.

BRIEF DESCRIPTION OF THE FIGURES

The invention is more fully appreciated in connection with the following detailed description taken in conjunction with the accompanying drawings, in which.

Like reference numerals refer to corresponding parts throughout the several views of the drawings.

DETAILED DESCRIPTION OF THE INVENTION

Figure 1:
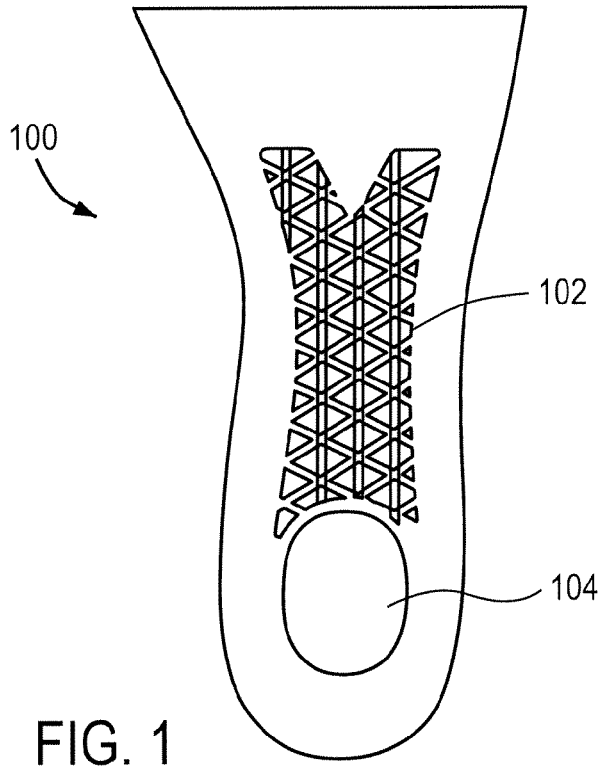
FIG. 1 is a bottom view of the heel region of a shank configured in accordance with an embodiment of the invention.

FIG. 1 is a bottom view of the rear portion of a shank 100 utilized in accordance with an embodiment of the invention. The rear portion of the shank 100 includes a honeycomb reinforcement structure 102, which provides strength benefits, while reducing mass. In one embodiment, the honeycomb reinforcement structure 102 has a convex shape. The honeycomb structure 102 is formed in the mid-sole region of the shank 100. The heel region of the shank 100 includes an aperture 104. The rear portion of the shank 100 may be formed with a relatively stiff polymer, such as polypropylene.

Figure 2:
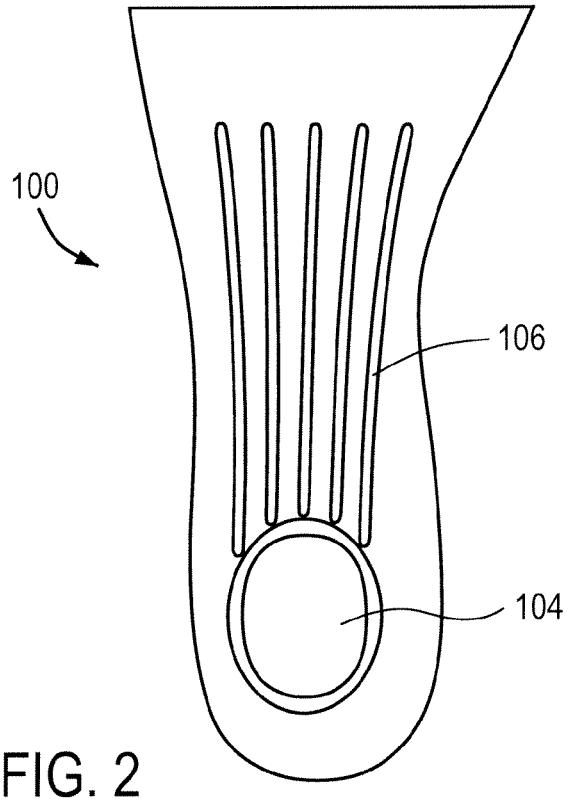
FIG. 2 is a top view of the heel region of a shank configured in accordance with an embodiment of the invention.

FIG. 2 is a top view of the rear portion of shank 100. The figure illustrates the aperture 104. The figure also illustrates that in one embodiment of the invention the shank 100 may include channels 106 to reduce shank mass. In sum, the channels 106 and honeycomb structure 102 provide a strong shank structure, but not at the expense of excessive mass.

Figure 3:
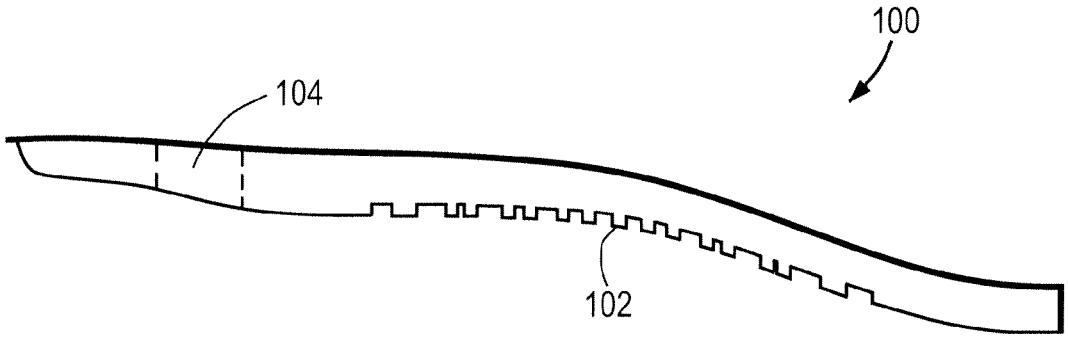
FIG. 3 is a side view of the heel region of a shank configured in accordance with an embodiment of the invention.

FIG. 3 is a side view of the rear portion of the shank 100. The figure illustrates the honeycomb structure 102 and shows the aperture 104 in phantom.

Figure 4:
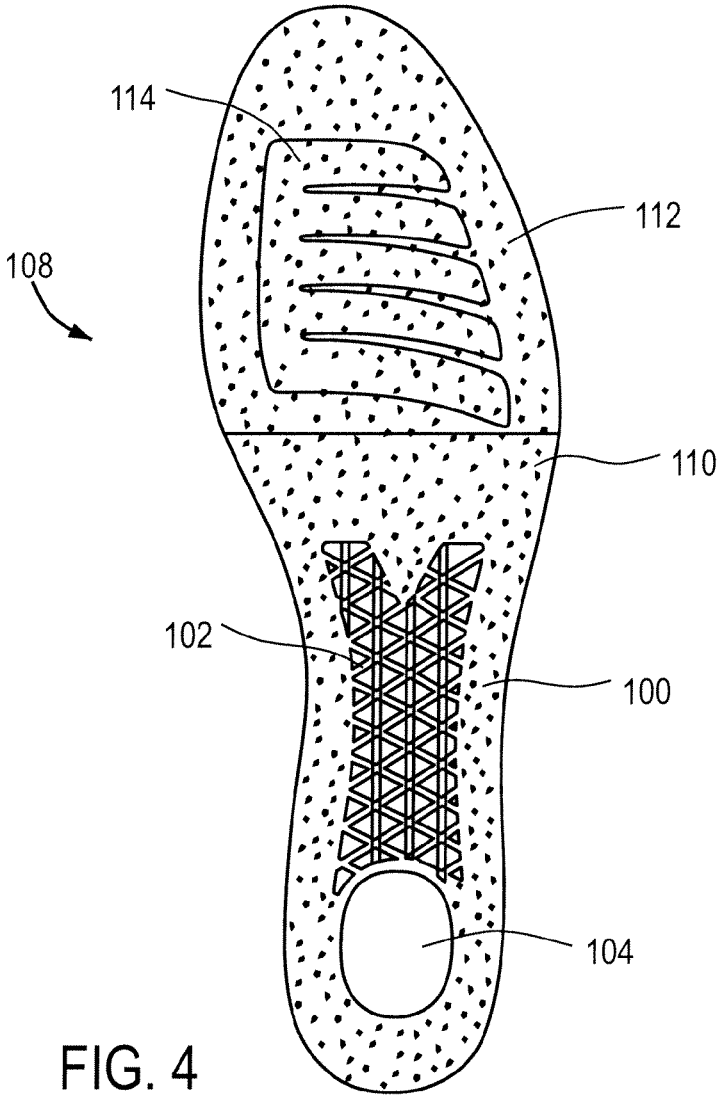
FIG. 4 is bottom view of a complete shank with a fabric sheath utilized in accordance with an embodiment of the invention.

FIG. 4 is a bottom view of a complete shank 108 utilized in accordance with an embodiment of the invention. The complete shank 108 has a first thickness in the rear portion 100 and a second thickness in a front portion 112. In one embodiment, the rear portion 100 has a thickness of approximately 9 mm and the front portion has a thickness of approximately 2 mm, with a natural sloping between these two thicknesses. The complete shank 108 is typically formed as a unitary structure. The rear portion of the shank 100 is shown separate for illustrative purposes.

A fabric sheath 110 (indicated with stippling) provides an improved mating surface with an adhesive. The fabric sheath may be formed with a non-woven material, such as a polyester-based fabric. The front portion of the shank 112 defines a rib receptacle 114.

Figure 5:
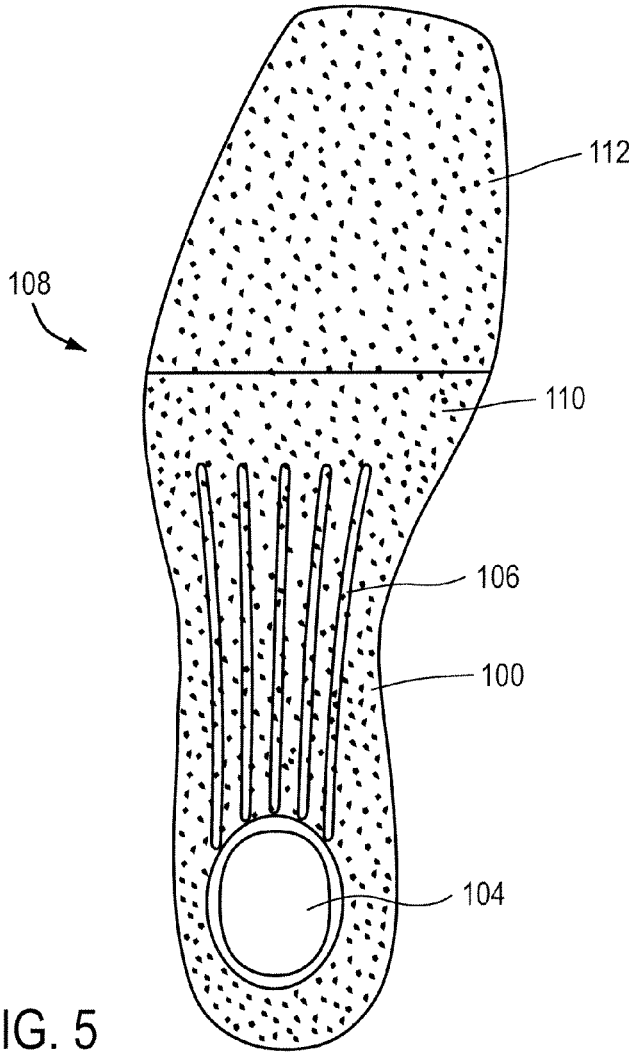
FIG. 5 is a top view of a complete shank with a fabric sheath utilized in accordance with an embodiment of the invention.
Figure 6:
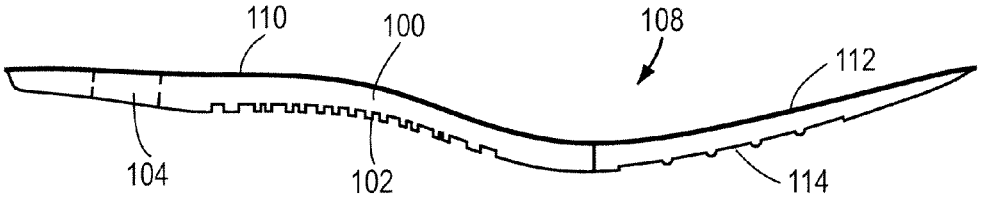
FIG. 6 is a side view of the shank and fabric sheath utilized in accordance with an embodiment of the invention.

FIG. 5 is a top view of the complete shank 108. The figure also illustrates the fabric sheath 110. FIG. 6 is a side view illustrating the rear portion of the shank 100 and the front portion of the shank 112.

Figure 7:
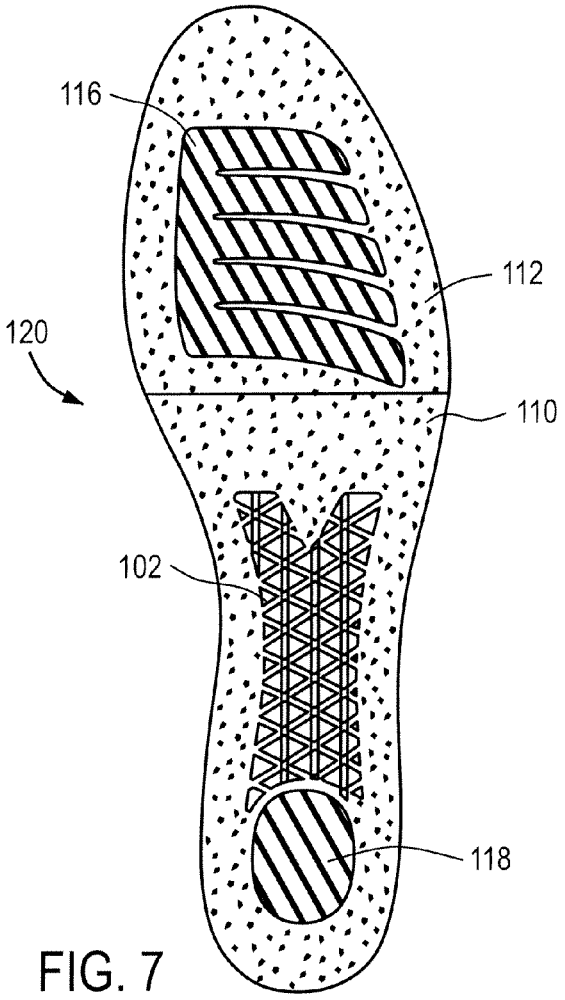
FIG. 7 is a bottom view of a footwear sole with polymer components configured in accordance with an embodiment of the invention.
Figure 8:
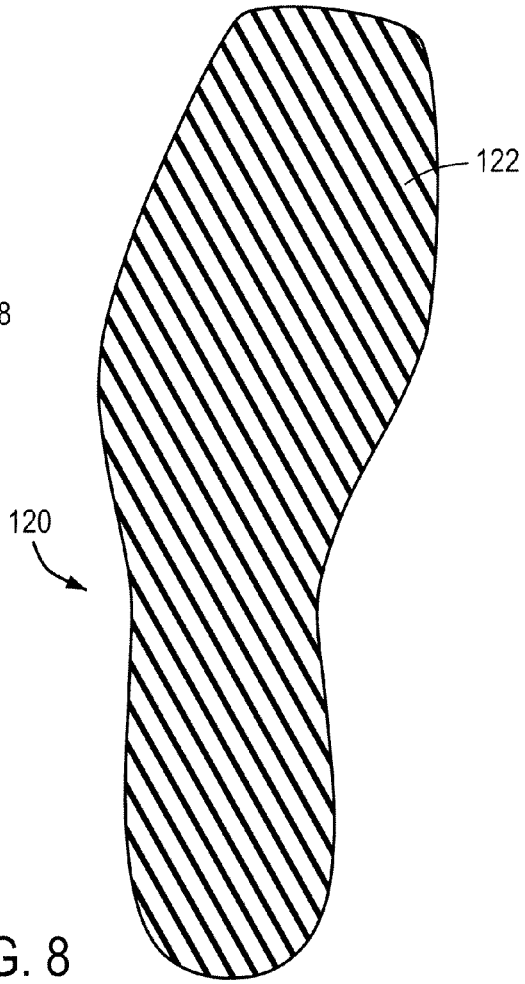
FIG. 8 is a top view of a footwear sole with a polymer bed utilized in accordance with an embodiment of the invention.
Figure 9:
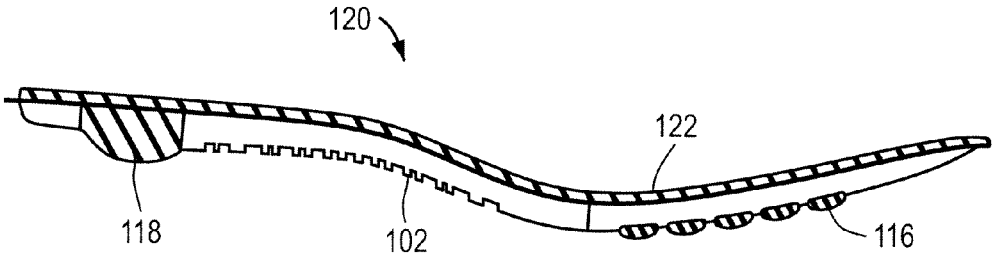
FIG. 9 is a side view of a footwear sole configured in accordance with an embodiment of the invention.

FIG. 7 illustrates a first polymer component 116 formed in the rib receptacle 114. The figure also illustrates a second polymer component 118 formed in the heel aperture 104. The first polymer component 116 may be polyurethane. The second polymer component may be a closed cell polyurethane, such as polyether polyol. The structure of FIG. 7 represents a bottom view of a completed footwear sole 120 of the invention. FIG. 8 is a top view of the footwear sole 120. The top layer has a third polymer component 122, which may be polyurethane. FIG. 9 is a side view of the footwear sole 120.

Those skilled in the art will appreciate that a variety of manufacturing techniques may be used to construct the footwear sole 120 of the invention. In one embodiment, a polymer component (e.g., a closed cell polyurethane) is formed in the heel aperture. In a subsequent operation, another polymer material (e.g., polyurethane) is applied to the rib receptacle and the top surface to form illustrated components 116 and 122. This order may be reversed. In addition, a single polymer application process may be utilized. Different polymer compositions may be used at some or all locations. Alternately, a single polymer composition may be used.

Figure 10:
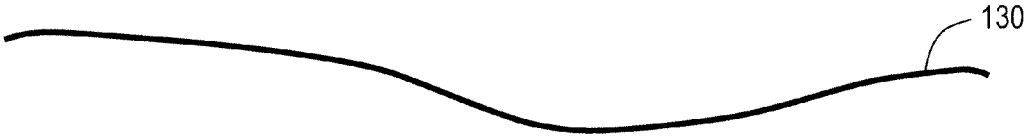
FIG. 10 is a fabric layer of a foot bed that may be utilized in accordance with an embodiment of the invention.
Figure 11:
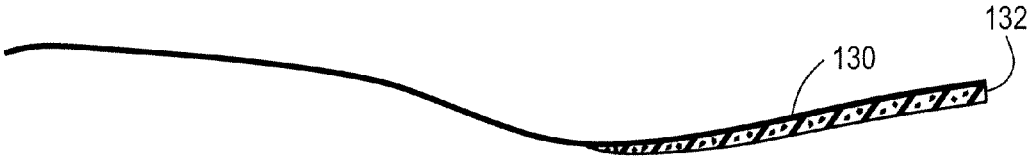
FIG. 11 is a fabric layer with a foam forefoot forming a portion of a foot bed utilized in accordance with an embodiment of the invention.
Figure 12:
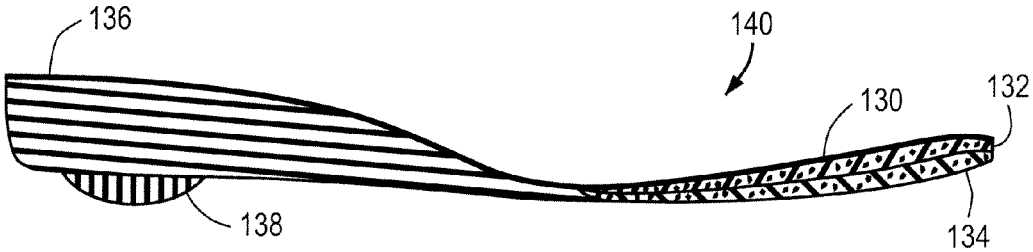
FIG. 12 illustrates a heel cradle, heel strike region, and foam matrix of a foot bed utilized in accordance with an embodiment of the invention.

FIG. 10 is a side view of an upper portion 130 of a shoe insert or foot bed. The upper portion 130 may be a fabric material. FIG. 11 illustrates a foam forefoot element 132 attached to the upper 130. FIG. 12 illustrates a foam matrix 134 attached to the foam forefoot element 132. The foam matrix 134 is formed in a grid pattern and may comprise an open cell polyurethane. FIG. 12 also illustrates a heel cradle 136 formed with a polymer, such as polyurethane. A heel strike region 138 is also formed. The heel strike region 138 may be formed with a polymer firmer than the polymer used for the heel cradle. The components of FIG. 12 form a completed shoe insert or foot bed 140.

Figure 13:
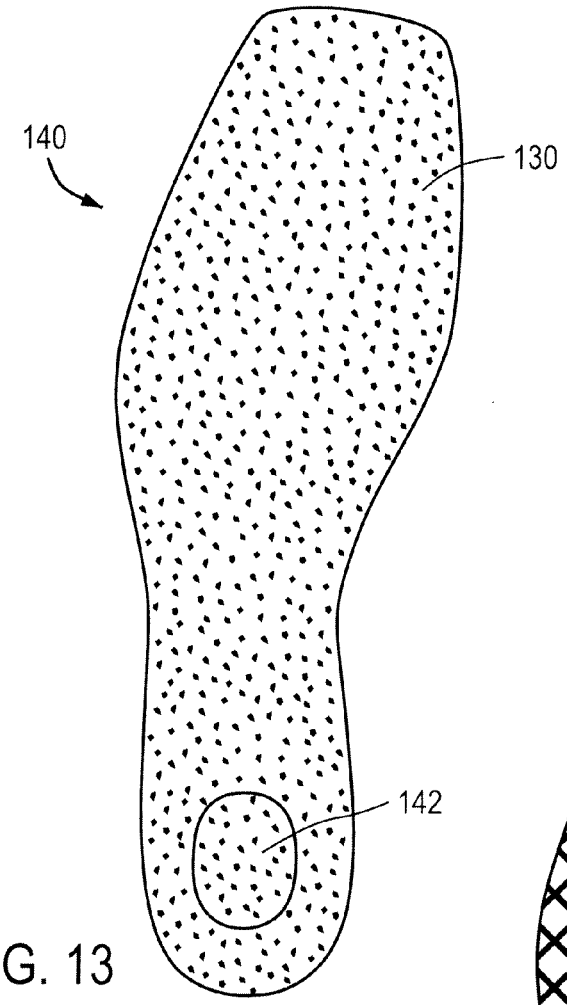
FIG. 13 is a top view of a foot bed of the invention.

FIG. 13 is a top view of the foot bed 140 illustrating fabric 130. The figure also illustrates that the heel strike region 142 may include a region defining a convex shape on the top of the insert.

Figure 14:
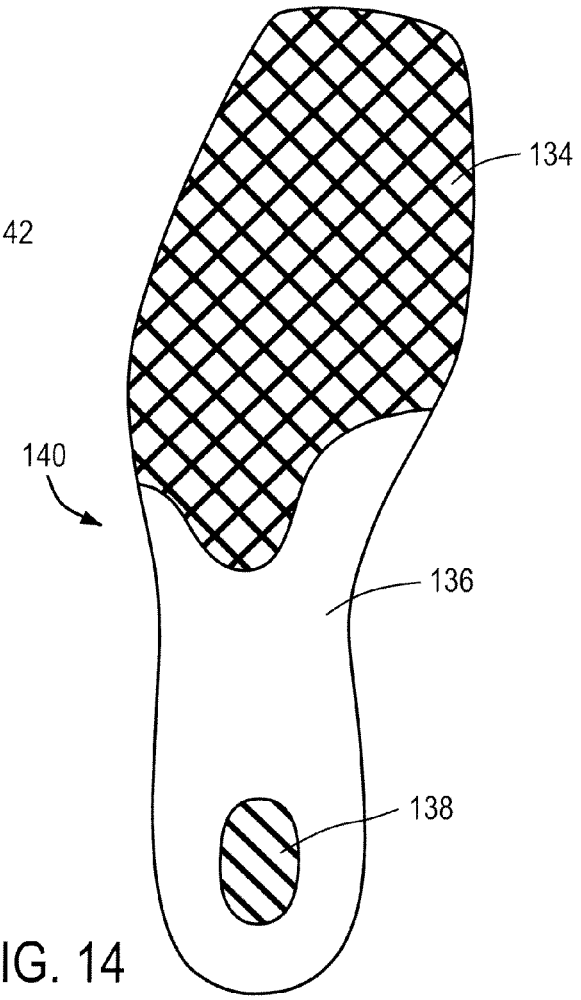
FIG. 14 is a bottom view of a foot bed of the invention.

FIG. 14 is a bottom view of the foot bed 140. The foam matrix 134 is illustrated. The grid pattern and open cell polyurethane promote moisture wicking for efficient heat transfer. The figure also illustrates the heel cradle 136 and heel strike region 138.

The foot bed 140 is placed on top of the footwear sole 120. Those skilled in the art will recognize many advantages associated with the disclosed foot bed 140 and footwear sole 120. The shank provides structural support, while being relatively lightweight in view of the honeycomb structure 102 and/or channels 106. The front portion of the shank may be used to define relief features, such as the rib receptacle. The fibs 116 allow for stabilization and flexibility. The heel cushion provides impact absorption. The top layer polymer 132 provides full foot impact absorption. The foot bed 140 includes a fabric layer 130 for moisture absorption. The forefoot foam 132 provides cushioning. The foam matrix 134 provides cushioning and moisture wicking, thereby enhancing heat transfer properties. The heel cushion 136 provides lower foot support, while the heel strike region provides impact absorption.

The foregoing description, for purposes of explanation, used specific nomenclature to provide a thorough understanding of the invention. However, it will be apparent to one skilled in the art that specific details are not required in order to practice the invention. Thus, the foregoing descriptions of specific embodiments of the invention are presented for purposes of illustration and description. They are not intended to be exhaustive or to limit the invention to the precise forms disclosed; obviously, many modifications and variations are possible in view of the above teachings. The embodiments were chosen and described in order to best explain the principles of the invention and its practical applications, they thereby enable others skilled in the art to best utilize the invention and various embodiments with various modifications as are suited to the particular use contemplated. It is intended that the following claims and their equivalents define the scope of the invention.

The invention claimed is:

1. A footwear sole, comprising:

a shank having a top side, a bottom side, a mid-sole region, and a heel region, the shank including:

a honeycomb reinforcement structure extending longitudinally in the mid-sole region and spaced inwardly in from lateral edges of the shank; and a heel aperture extending through the heel region of the shank from the top side of the shank to the bottom side of the shank; and a polymer component covering the top side of the shank in the mid-sole region and the heel region; wherein the polymer component further extends from the top side of the shank, through the heel aperture, and away from the bottom side of the shank.

2. The footwear sole of claim 1 wherein the honeycomb reinforcement structure has a convex shape.

3. The footwear sole of claim 1 wherein the shank is formed of polypropylene.

4. The footwear sole of claim 1 wherein the honeycomb reinforcement structure is on a bottom side of the shank.

5. The footwear sole of claim 4, wherein the shank includes channels on the top side of the shank.

6. The footwear sole of claim 5, wherein the channels extend longitudinally in the mid-sole region and are generally opposite the honeycomb reinforcement structure, and wherein the polymer component extends into the channels.

7. The footwear sole of claim 1 wherein the shank further includes a fabric sheath surrounding the shank.

8. The footwear sole of claim 7 wherein the fabric sheath is a polyester-based fabric.

9. The footwear sole of claim 1 wherein the polymer component includes polyurethane.

10. The footwear sole of claim 1 wherein the polymer component includes a closed cell polyurethane.

11. The footwear sole of claim 10 wherein the polymer component includes polyether polyol.

12. The footwear sole of claim 1 in combination with a foot bed insert.

13. The footwear sole of claim 12 wherein the foot bed insert includes a fabric upper layer.

14. The footwear sole of claim 13 wherein the foot bed insert includes a foam forefoot component attached to a bottom of the fabric upper layer.

15. The footwear sole of claim 14 wherein the foot bed insert includes a foam matrix connected to the foam forefoot component.

16. The footwear sole of claim 15 wherein the foam matrix is formed from an open cell polyurethane.

17. The footwear sole of claim 12 wherein the foot bed insert includes a heel cradle.

18. The footwear sole of claim 17 wherein the foot bed insert includes a heel strike region in a central heel region of the foot bed insert, wherein the heel strike region projects from a bottom surface of the foot bed insert, and wherein the heel cradle is of a first firmness and the heel strike region is of a second firmness greater than the first firmness.

19. The footwear sole of claim 1, wherein the polymer component is a first polymer component, and wherein the shank further includes a forefoot region that is connected to the mid-sole region, wherein a bottom side of the forefoot region defines a rib receptacle, and wherein a second polymer component extends in the rib receptacle.

20. The footwear sole of claim 1, wherein the polymer component extends through the heel aperture.

21. The footwear sole of claim 1, wherein the shank has a front portion and a rear portion that is thicker than the front portion.

22. A footwear sole, comprising:

a shank having a shank forefoot region, a shank mid-sole region, a shank heel region, a shank top side, a shank bottom side, and lateral edges, wherein the shank forefoot region, the shank mid-sole region, and the shank heel region are formed as a unitary structure and are positioned generally underneath corresponding regions of a wearer's foot when the footwear sole is incorporated into an article of footwear that is worn by the wearer, wherein the shank includes:

a body, wherein the body includes a stiff honeycomb reinforcement structure extending longitudinally in the shank mid-sole region and spaced inwardly in from the lateral edges, and wherein the body defines an aperture extending through the shank heel region of the shank from the shank top side to the shank bottom side; and a polymer component covering the shank top side in the shank forefoot region, the shank mid-sole region, and the shank heel region; wherein the polymer component further extends from the shank top side, through the aperture, and away from the shank bottom side.

23. The footwear sole of claim 22, wherein the honeycomb reinforcement structure is on the shank bottom side, wherein the body further defines a plurality of channels extending longitudinally on the shank top side and generally opposite the honeycomb reinforcement structure.

* * * * *